US005305888A

United States Patent [19]

Meylor et al.

[11] Patent Number: 5,305,888

[45] Date of Patent: Apr. 26, 1994

[54] FRUIT/VEGETABLE FLOATATION GRADING

[76] Inventors: Donald M. Meylor, 22316 Harkwood, El Toro, Calif. 92630; Patrick J. Finn, 845 Paularine Ave., Apt. E320, Costa Mesa, Calif. 92626

[21] Appl. No.: 920,017

[22] Filed: Jul. 27, 1992

[51] Int. Cl.[5] ..... B03B 5/28; B03D 1/00

[52] U.S. Cl. ..... 209/164; 209/169; 209/173; 426/478; 426/485

[58] Field of Search ..... 209/162, 163, 164, 165, 209/173, 169, 168, 170; 426/484, 485, 478

[56] References Cited

U.S. PATENT DOCUMENTS

| | | | |
|---|---|---|---|
| 1,195,264 | 8/1916 | Pennington | 209/170 |
| 2,300,777 | 11/1942 | Coons | 209/173 |
| 2,359,414 | 10/1944 | Frova | 209/173 |
| 2,450,398 | 9/1948 | Sanders | 209/165 |
| 2,571,056 | 10/1951 | Olney | 209/173 |
| 2,689,650 | 9/1954 | Key | 209/170 |
| 2,753,045 | 7/1956 | Hollingsworth | 209/170 |
| 2,783,884 | 3/1957 | Schawb | 209/170 |
| 2,808,615 | 10/1957 | Snow | 452/12 |
| 2,945,589 | 7/1960 | Olney | 209/173 |
| 3,250,394 | 5/1966 | Clark | 209/170 |
| 3,271,293 | 9/1966 | Clark | 209/170 |
| 3,298,519 | 1/1967 | Hollingsworth | 209/170 |
| 3,322,272 | 5/1967 | Evans | 209/170 |
| 3,701,565 | 10/1972 | Gutterman | 209/173 |
| 3,702,656 | 11/1972 | Gutterman | 209/173 |
| 3,722,035 | 3/1973 | Hanks | 452/14 |
| 3,822,015 | 7/1974 | Hsieh | 209/173 |
| 4,225,424 | 9/1980 | Patzlaff | 209/173 |
| 4,231,974 | 11/1980 | Engelbrecht | 209/170 |
| 4,253,941 | 3/1981 | Lawson | 209/173 |
| 4,253,942 | 3/1981 | Gaumann | 209/170 |
| 4,272,461 | 6/1981 | Franklin | 210/220 |
| 4,294,691 | 10/1981 | Patzlaff | 209/173 |
| 4,332,677 | 6/1982 | Budzich | 209/173 |
| 4,336,144 | 6/1982 | Franklin | 210/767 |
| 4,374,030 | 2/1983 | Franklin | 210/221.2 |
| 4,375,264 | 3/1983 | Porter | 209/173 |
| 4,478,710 | 10/1984 | Smucker | 209/170 |
| 4,822,493 | 4/1989 | Barbery | 209/170 |
| 4,858,769 | 8/1989 | DeVries | 209/173 |
| 5,091,083 | 2/1992 | Meylor et al. | 209/169 |

FOREIGN PATENT DOCUMENTS

| | | | |
|---|---|---|---|
| 33118 | 10/1921 | Norway | 209/170 |
| 984490 | 12/1982 | U.S.S.R. | 209/170 |

*Primary Examiner*—Thomas M. Lithgow
*Attorney, Agent, or Firm*—Arthur Freilich; Robert D. Hornbaker; Leon D. Rosen

[57] ABSTRACT

A floatation separation method is described for separating pieces of fruit or vegetable of the same type, but wherein desirable pieces have a slightly different specific gravity from the undesirable ones, and all have a specific gravity about the same as that of water. The pieces (12, FIG. 3) are placed near the surface of a body of water, and a cloud (40) of tiny air bubbles is maintained in the water. As the bubbles float to the surface they encounter the articles and slightly increase their buoyancy. The increase in buoyancy is slight and uniform, so those articles having a density slightly greater than that of the water will remain at the water surface, while those of a slightly greater density cannot be floated by the air bubbles and will sink to the bottom. The cloud of air bubbles is created by allowing air at about atmospheric pressure, to emerge from apertures in a rapidly spinning rotor that open in a direction primarily opposite to the spin direction.

9 Claims, 2 Drawing Sheets

FIG. 4
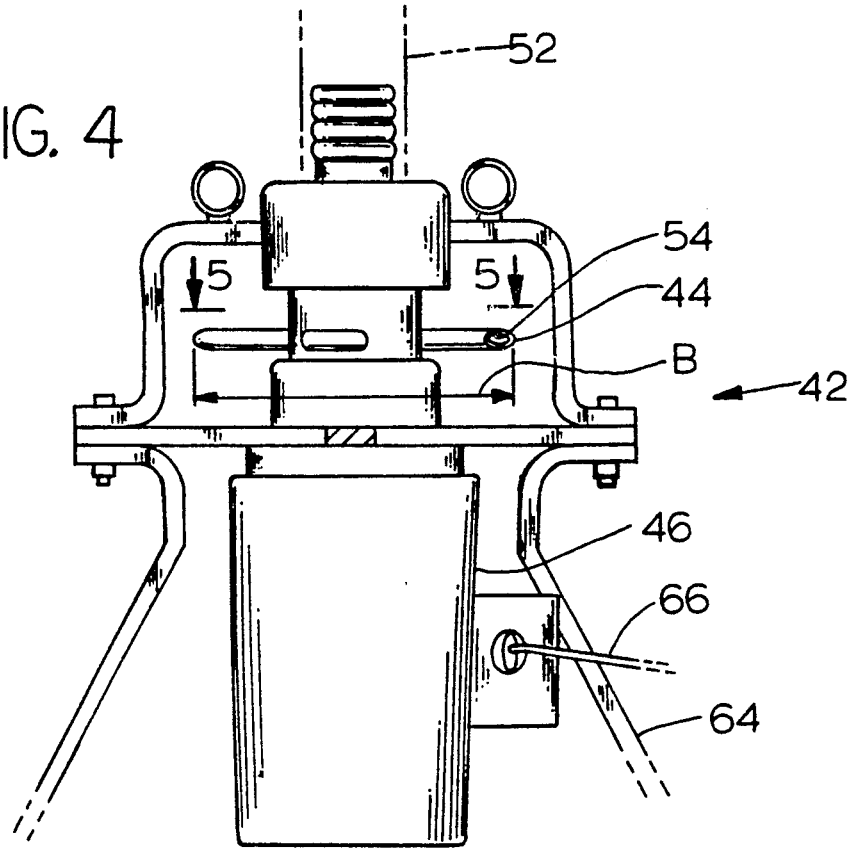
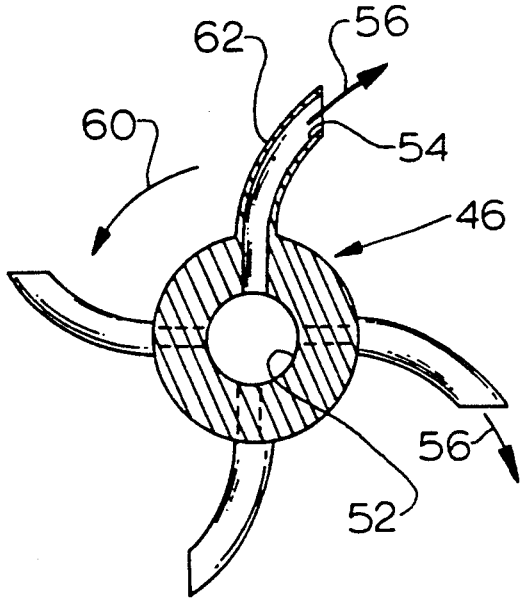
FIG. 5
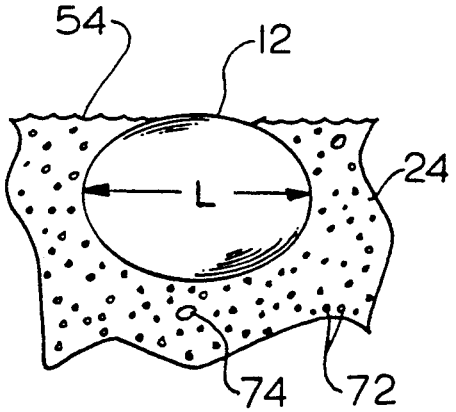
FIG. 6

FRUIT/VEGETABLE FLOATATION GRADING

BACKGROUND OF THE INVENTION

A wide variety of pieces of fruit and vegetable have a specific gravity that is close to that of water and usually slightly greater than that of water. Desirable and undesirable articles often have slightly different densities, and such articles have often been separated by floatation separation. In floatation separation, the articles are placed in a body of liquid such as water, and those with slightly greater specific gravity, such as the undesirable ones, sink in the water while those of slightly smaller specific gravity than the others float on the surface.

One example of such separation is in the olive industry, where a pitting tool is used to remove the pits from olives to provide pitted olives. The pit removal process sometimes fails, usually leaving a significant fragment of the pit in the olive. A major liability faced by companies selling pitted olives, is lawsuits from persons who have broken a tooth on a pit fragment remaining in a supposedly pitted olive. One technique that has been successfully used to remove pitfailed olives (those from which not all of the pit has been removed), is to float the olives in a pool of salt water. The pitfailed olive containing all or a major portion of the pit has a density of about 1.05, while a pitted olive containing only the pulp (the desirable part without the pit) has a density of about 0.99 to 1.01. The density of water can be increased to about 1.11 by increasing its salinity up to about 15%. By adding sufficient salt to fresh water to increase the density to about 1.02, the pool of salt water can be used to float those olives which have been pitted from those which have been pitfailed. The exact per cent of salt, and therefore the exact density of the salt water, is adjusted for the particular batch of olives to be floatation separated.

Environmental concerns have made it difficult for olive processors to use salt water for floatation separation. The salt water has to be frequently changed, such as every day to avoid excessive odors. The salt in the water makes it an undesirable sewer discharge, where water from the treated sewage will be reused either directly or by way of rivers or underground water. Sugar can also be added to water to increase its density, but sugar water is also an undesirable sewer discharge because it is difficult to clean. A floatation separation system for distinguishing pitted olives from pitfailed olives, which avoided the need for highly salted or sugared water, would be of considerable value. Such a floatation separation system could also be valuable in separating other pitted fruits such as cherries, as well as in separating articles of fruit or vegetables which have a specific gravity close to that of water but wherein desirable pieces have a slightly different specific gravity from undesirable ones.

SUMMARY OF THE INVENTION

In accordance with one embodiment of the present invention, a method and apparatus are provided for the floatation separation of pieces of fruit or vegetable, which enable the separation operation to be conducted in a pool of liquid having a lower specific gravity than a large portion of both the desirable and undesirable pieces, and which facilitates adjustment of the effective specific gravity of the liquid. Where it is undesirable to use water to which salt or sugar has been added to increase the water density, the present method and apparatus enables fresh water to be used even though it has a slightly lower specific gravity than salted or sugared water. The method includes placing the pieces to be separated in a body of liquid, and introducing and maintaining a bubble cloud in the body, consisting of multiple small gas bubbles introduced below the floating pieces. The gas bubbles rise toward the surface and tend to add a slight buoyancy to the pieces, so those pieces having a specific gravity very slightly greater than that of the liquid can still float at the surface of the liquid, while those pieces of slightly greater specific gravity will sink. The rate of bubble formation can be varied to float articles of slightly greater or lesser specific gravity and sink the others.

A large rate of small bubble formation can be achieved by placing a rotor in the pool of water and rapidly rotating it while carrying the gas to openings in the rotor that open in a direction primarily opposite to the direction of rotor spinning. Where the gas is air, the conduit can comprise a pipe extending out of the pool of water and opening directly to the atmosphere.

The novel features of the invention are set forth with particularity in the appended claims. The invention will be best understood from the following description when read in conjunction with the accompanying drawings.

BRIEF DESCRIPTION OF THE DRAWINGS

FIG. 4 is a partial side elevation view of the air bubble generator of the apparatus of FIG. 1.

FIG. 5 is a sectional view taken on the line 5—5 of FIG. 4.

FIG. 6 is a side elevation view of an olive in the apparatus of FIG. 1, indicating the process by which the air bubbles increase the effective buoyancy of an olive.

DESCRIPTION OF THE PREFERRED EMBODIMENT

Figure 1:
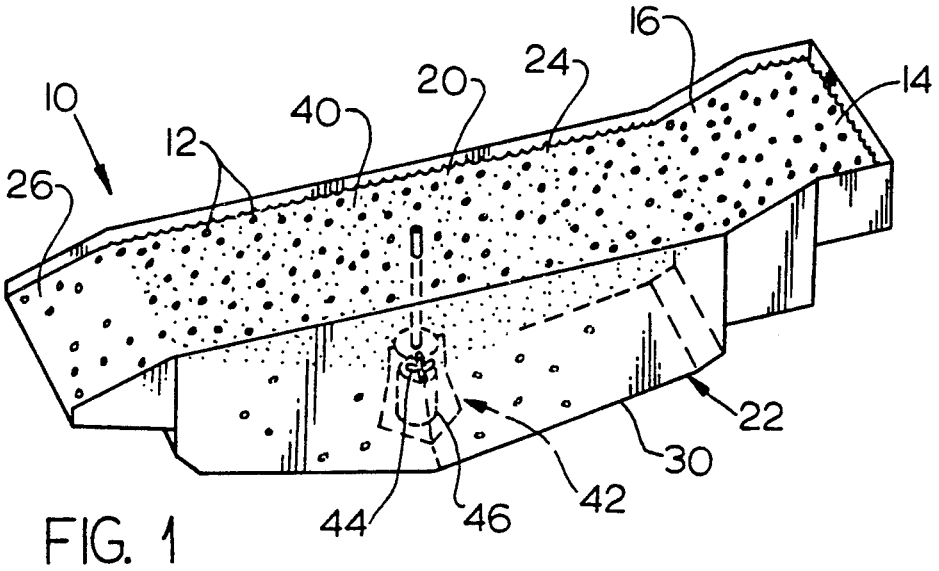
FIG. 1 is an isometric view of a floatation separation apparatus constructed in accordance with the present invention.
Figure 2:
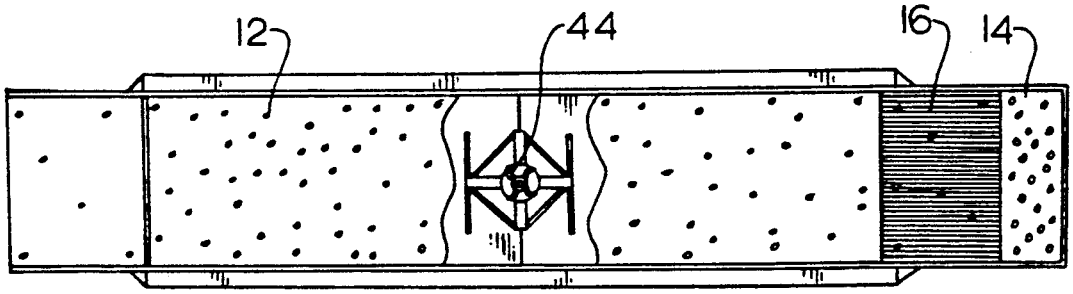
FIG. 2 is a plan view of the apparatus of FIG. 1.

FIG. 1 illustrates a floatation separation apparatus 10 which can receive pieces or articles of a fruit or vegetable, to separate one group of them from another. The particular pieces 12 of fruit or vegetable shown are olives. Most of the olives are pitted olives (olives from which the pit has been completely removed), while the other olives are pitfailed olives which contain the entire pit or, more commonly, a substantial portion of the original pit. Most pieces of fruit and vegetable have a specific gravity close to that of fresh water. In the case of olives, the pulp (the part other than the pit) has a density of about 0.99 to 1.01, while the olive with a full pit has a density of about 1.05. As a result, those olives which contain a substantial portion of the pit will generally have a density of more than 1.01. This slight difference in density between the two different groups enables their separation by floatation.

Figure 3:
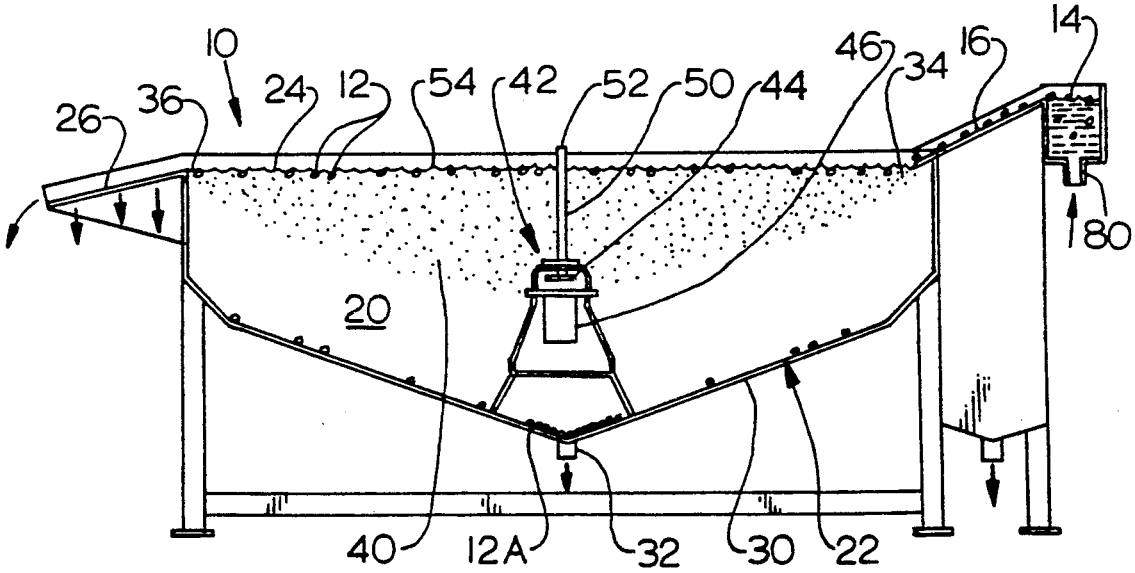
FIG. 3 is a sectional side view of the apparatus of FIG. 1.

In the apparatus of FIG. 3, olives to be separated are introduced into a supply region 14, as by pumping water containing olives into an inlet 80 leading to the region. Olives and water flow out of the supply region 14 down a ramp 16 into a pool of water 20 held by a container or tank 22. The pool is the body of water in which some olives can sink to a depth well below those that float, to enable separation. The olives initially float at the surface region 24 of the pool of water while slowly moving in a downstream direction toward an exit ramp 26. Those olives which have a partial or complete pit have a slightly greater density than the others, and sink in the pool of water to the bottom 30 of the tank. The sunk olives 12A are removed through a sunk olive outlet 32. Thus, the desirable olives are separated from the undesirable ones, because the undesirable ones have a slightly greater specific gravity and sink to the bottom of the tank from which they are removed, while the desirable olives remain floating in the tank until they are removed from the surface region of the tank. The pool of water 20 in the tank may be considered to have opposite sides 34, 36 at opposite sides or ends of the tank, and the olives are separated as they move from one side 34 toward the other.

Fresh water has a specific gravity very close to 1.00 at room temperature. Since the desirable olives have a density of up to about 1.01, a large proportion of the desirable olives would sink in a pool of fresh water, along with the undesirable olives which have an even higher density. In the prior art, the density of the water was increased slightly by adding salt or sugar to it. The density of water can be increased by up to about 1.11 by adding up to 15% salt by weight. The density of the water can be increased to about 1.02 by adding about 3% by weight of salt. However, the salt water has to be changed about every day to avoid objectionable odors, which means that the salt water must be dumped down a sewer or the like. Recent environmental concerns have led to laws limiting the discharge of large amounts of salt or sugar. This has led to the need for a separation system that can function well without the need for large amounts of salt or sugar water. It may be noted that the use of salt for floatation is undesirable in separating many types of fruits and vegetables because the salt affects the taste, although this is not a problem in olives which are packed in a brine solution.

In accordance with the present invention, applicant applies a cloud 40 of gas bubbles to the pool 20 of water to slightly increase the effective buoyancy of the pieces of fruit or vegetable, such as the olives 12. The effective increase in buoyancy of the olives enables applicant to use fresh water, which has a density of about 1.00 at room temperature, to float substantially all pitted olives which have a density between about 0.99 and 1.01. Furthermore, the increase in effective buoyancy is very small, so that it can be raised only slightly, to allow pitfailed olives having a density such as 1.05, to sink to the bottom of the pool of water. Applicant finds that the rate of bubble creation, or density of bubbles in the cloud 20, has a major effect on the increase in effective buoyancy. Accordingly, varying the density of bubbles in the cloud can be used to slightly vary the effective buoyancy of the olives.

The cloud of bubbles is created by an air bubble generator 42 which includes a rotor 44 that rotates rapidly within the pool of water while ejecting air from openings in the rotor. A motor 46 rapidly rotates the rotor. An air tube 50 extending upwardly from the air generator, with its top 52 above the surface 54 of the water takes in air, which is released through the rotor.

As shown in FIG. 5, the rotor 46 has a plurality of openings 54 coupled to the air tube 52. The openings face in directions indicated by arrows 56, which are primarily opposite to the direction of rotation 60 of the rotor. The particular rotor shown has four hollow blades that form four openings. Applicant finds that when the rotor turns rapidly in the direction 60, air is released through the openings 54 at a high rate, and that the air immediately breaks into bubbles of very small diameter. The small diameter, which averages less than 0.1 millimeter, is desirable because the bubbles rise slowly. Applicant believes that this breakup of the emitted air is due to the cavitation effect of the arms 62 rapidly moving through the water. The air flows rapidly down through the air tube 52 and out through the openings 54, without the need for an air pump to pump down the air. The particular bubble generator 42 has a stand 64 (FIG. 4) to facilitate its positioning in the tank. A cable 66 carries electricity to the motor to energize it.

Applicant has constructed and tested a float separation apparatus 10 of the type illustrated, and found that it was even more effective in separating pitted from pitfailed olives than the prior technique involving floating in salt water without bubbles. That is, applicant's apparatus allowed a higher percentage of pitted olives to float while causing a higher percentage of pitfailed olives to sink. In order for any floatation separation apparatus to effectively separate desired from undesired pieces or articles of fruit or vegetable, at least 90% of one group such as the desired group must float in the pool of water, while at least 90% of the other group such as the undesirable one must sink (assuming there has not been a previous separation). In practice, applicant's apparatus floats over 99.9% of the pitted olives, and sinks over 99% of the pitfailed olives.

It appears that the way in which the bubbles increase the effective buoyancy of the olive is by repeatedly bumping into them as the bubbles rise towards the surface of the pool of water. FIG. 6 shows an olive 12 floating at the surface region 24 of the pool of water, while a large number of bubbles float up through the pool. Most of the bubbles shown at 72 have a diameter much less than 1 millimeter and therefore a volume much less than one cubic millimeter, as compared to a typical olive length L of about 1.5 centimeters and therefore a volume of over 2000 cubic millimeters which is more than 100 and more than 1000 times the volume of most of the air bubbles. Petite olives can have a length as small as about 0.5 cm. The bubbles reaching the bottom of the olive appear to slide off the olive and burst at the surface 54, but temporarily increase the buoyancy of the olive. So long as there is a very high density of very small bubbles rising under the olives, and the bubbles continually rise to substantially all areas of the surface of the water pool, there will be a substantially uniform increase in effective buoyancy of the olives during their slow movement along the length of the tank.

Applicant operates the apparatus 10 so that it requires a considerable time such as five minutes for the olives to pass a distance of about ten feet which is the length of the tank. During this period of time, each olive encounters thousands of bubbles. If an olive did not encounter many bubbles during a short period of time such as a few seconds, the olive would sink only very slowly due to the fact that its density is very close to that of water. Thus, the apparatus will float the desired olives so long as there is moderate uniformity in the cloud of bubbles. Also, it generally requires a substantial period of time of more than one-quarter minute, and usually several times as much, to reliably separate the two groups of olives as they lie in the pool of water. The increase in effective buoyancy applied to the pitfailed olives is not sufficient to keep them afloat, and they will very slowly sink to the bottom of the tank. Thus, the very large number of bubbles, or high density of bubbles in the cloud 40 of bubbles, that impinge upon the olives during the considerable period of time of their passage, results in a uniform increase in buoyancy on the olives.

In an apparatus that applicant has constructed and operated, the rotor had a diameter B (FIG. 4) of six inches and the shape shown, and was rotated by a motor 46 whose speed could be varied between 1200 and 1700 rpm. Applicant found that this resulted in an air flow into the air tube 52 and out through the rotor openings 54, of between about one and two cubic feet per second. Of course, the number of openings, diameter of the rotor, size of the air tube, and speed of rotation can affect the flow rate of air, and therefore the density of bubbles in the cloud.

In the operation of the apparatus of FIG. 3, applicant first energizes the motor 46 for a period such as fifteen seconds, to create the cloud 40 of bubbles, which spreads out to cover the entire surface region of the tank. Thereafter, the motor continues to be energized to maintain the cloud, until the equipment is shut down for maintenance and is not used for separating olives. The particular tank shown has a length of ten feet, a width of three feet, and an average depth of about four feet. After the cloud of bubbles has been created, applicant pumps water with olives therein up through an entrance 80 leading to the supply region 14, so the olives move upwardly therein and then move down along the ramp 16 into the pool of water 20 in the tank 22. The water in the tank is water supplied by the city to any resident, which contains only a small amount of additives (e.g. chlorine to kill bacteria), so its density is very close to 1.00. Water at the surface of the pool moves across the length of the tank in about five minutes, and those olives still floating at the surface region of the water pass out of the pool of water and down the exit ramp 26 into a container. A skimmer can be used to help move the olives onto the exit ramp. It is noted that water passing down through the exit ramp 26 is recovered from the olives passing along the ramp, and returned to the apparatus. It also may be noted that the entrance ramp 16 comprises a screen at the top, to allow the passage only of olives above a predetermined size.

Those olives with a slightly higher density, which represents primarily pitfailed olives, sink to the bottom 30 of the tank and are removed through the sunk olive outlet 32. The fact that the water in the system is "fresh" water, that is, water without a substantial percentage of additives such as salt or sugar, results in the water being usable for a longer period than salt water, before it develops an appreciable odor and the water must be changed. The fresh water which is slightly contaminated by the processing of the olives, normally can be dumped into an ordinary sewer system. This is because the water does not contain a large proportion of salt or the like, which would contaminate a river or underground water to Which it flows (often after some treatment by a municipal water system).

Different batches of olives may have slightly different densities, which can be accounted for by varying the rate of rotation of the rotor motor, and therefore varying the flow rate of air flow and therefore the density of bubbles in the cloud. Where the tank is large so the pool of water at the top of the tank has a much larger area, a more uniform high density of bubbles can be maintained by installing two or three or even more of the air bubble generators. As mentioned above, the bubbles from the generator appear to become substantially uniformly distributed over a very wide area.

As discussed above, most fruits and vegetables have a density that is close to 1. Where desirable fruits can be distinguished from undesirable ones, by the differences in density, such as unripe blueberries from ripe ones or pitted cherries from unpitted ones, this also can be accomplished by the apparatus and method of the invention. Where some of the pieces of both groups have a density slightly greater than one, such separation can be accomplished in a tank filled with water, and in which a cloud of bubbles is established. Most of the bubbles have a volume of much less than one cubic millimeter while most pieces of fruit or vegetable, including peas, have a volume of a plurality of cubic millimeters. Thus, the pieces of fruit will almost never be entrapped in a bubble, as could happen with microscopic particles. Other liquids can be used where the density is less than that of fresh water or is considerably greater than fresh water. Where it is desirable to avoid more rapid oxidation of the pieces of fruit or vegetables by the air bubbles, this can be avoided by introducing an inert gas such as nitrogen into the rotor instead of air.

It may be noted that there have been prior attempts to generate air bubbles in water tanks, generally by applying air under a high pressure such as 100 psi or more to the water to dissolve the air in the water. Then, the pressured water with dissolved air is open to water in the tank which is at nearly atmospheric pressure, to cause the air to be released from the water. It is found that such processes do not produce large numbers of tiny bubbles, but instead tend to create a limited amount of air, and with much of it in the form of large bubbles that quickly rise to the surface instead of becoming uniformly distributed.

Thus, the invention provides a method and apparatus for the float separation of pieces or articles of fruit or vegetable by floatation separation. The method includes applying a multiplicity of tiny bubbles of gas, such as of air, in a cloud to an underwater location, while establishing the articles to be separated in the water, preferably in the surface region of the water. The cloud contains bubbles that rise to the surface, with new bubbles continually rising to take the place of those which have previously risen and burst at the surface. The multiple small bubbles cause an effective increase in buoyancy of the articles. Where the articles such as pieces of fruit or vegetable have a density slightly greater than 1.0, for both groups such as the desirable and undesirable articles, the bubbles slightly decrease the effective density of the articles, or add slight buoyancy, so that those articles of slightly smaller density can float on the water, even though they have an actual density greater than that of water. The articles of higher density are not sufficiently buoyed by the bubbles to float, and thereby sink. The bubbles can be created by a rotor that lies underwater and is rapidly turned, and which has openings which are supplied with gas such as air. The openings or apertures, open in directions primarily opposite to the direction of movement of the apertures as the rotor rotates. The rapid rotation appears to cause cavitation, resulting in the creation of large numbers of very small bubbles.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A method for separating first and second groups of articles of fruit or vegetable, wherein almost all articles of said first group have a slightly lower density than the articles of said second group, comprising:

feeding the articles of said first and second group, wherein substantially every article of said groups has a volume of a plurality of cubic millimeters, to the surface of a pool of liquid having a specific gravity slightly less than some of said articles of said first group, and moving said articles along a path in said pool, so some of said placed articles of said first group and almost all of said placed articles of said second groups tend to sink in said liquid from a location near the surface of the liquid as said articles move along said path;

continually maintaining a cloud of gas bubbles of an average volume of less than one cubic millimeter in said body of liquid below substantially all of said path of articles in said pool, which includes bubbles that continually rise in substantially the entire surface region of said body which contains said articles, including creating new gas bubbles at a rate sufficient to float substantially all of said first articles including those having a slightly greater density than the density of said liquid in the absence of gas bubbles, but not said second articles;

the articles of said first and second group remaining on said path and being exposed to said cloud of gas bubbles for at least 30 seconds.

2. The method described in claim 1 wherein:

said first and second groups of articles are pieces of the same type of fruit, with a majority of articles of each group having a specific gravity which is greater than 1.0 and which lies between 1.0 and 1.1, and said liquid is fresh water having a specific gravity of 1.0.

3. The method described in claim 1 wherein:

substantially all of said bubbles have a volume less than one-hundredth the average volume of said articles of said first and second group.

4. The method, described in claim 1 wherein:

each of substantially all of said pieces of fruit or vegetable have a volume of a plurality of cubic millimeters, and most of said bubbles have a volume of less than one cubic millimeter.

5. The method described in claim 1 wherein: 'said pool of liquid lies in a tank and has opposite sides, and said step of moving includes moving said articles slowly along said path with said path lying at the surface of said liquid, from one of said sides to substantially said opposite side;

said step of maintaining a cloud includes establishing bubbles that rise from below said articles along substantially the entire path of said articles in said pool.

6. A method for separating fully pitted fruit, which represents fruit of a particular kind which originally contained a pit but from which the pit has been fully removed, from pitfailed fruit of the kind from which only part or none of the pit has been removed, where the pitted fruit has a slightly lower density than the pitfailed fruit, but both generally have a specific gravity slightly greater than that of fresh water, and both have a volume of a plurality of cubic millimeters, comprising:

feeding said pitted and pitfailed fruit to the the surface region of a pool of fresh water from one side thereof toward another side thereof;

continuously creating bubbles in said pool, of an average diameter of less than one millimeter, to maintain a cloud of bubbles therein, and allowing said bubbles to float up against said fruit during substantially the entire passage of those pieces of fruit which pass from said one side to said another side, said passage with said bubbles floating up against the fruit being at least 30 seconds said bubbles being created at a sufficient rate to keep more than 90% of said pitted fruit, but less than 10% of said pitfailed fruit floating at the surface region of said pool of water, including keeping pitted fruit having a density greater than the density of said fresh water floating at the surface region of said pool of water.

7. The method described in claim 6 wherein:

said step of creating bubbles comprises creating said bubbles of an average diameter of no more than 0.1 millimeter.

8. The method described in claim 6 wherein:

said fruit comprises olives.

9. The method describes in claim 6 wherein:

said step of creating bubbles includes varying the rate of air flow which results in said bubbles, in accordance with variation of specific gravity of the pitted fruits of the particular batch of fruit which is being separated.

* * * * *